United States Patent [19]

Georgi

[11] 3,945,768

[45] Mar. 23, 1976

[54] FLUID MOTOR DRIVES PUMP HAVING AN ACTIVE INLET VALVE

[75] Inventor: Donald K. Georgi, Minneapolis, Minn.

[73] Assignee: Graco Inc., Minneapolis, Minn.

[22] Filed: Nov. 6, 1974

[21] Appl. No.: 521,292

[52] U.S. Cl. ..... 417/317; 417/402

[51] Int. Cl.[2].. F04B 9/00; F04B 17/00; F04B 35/00

[58] Field of Search ..... 417/402, 317, 318, 507, 417/508, 401, 403, 404

[56] References Cited

UNITED STATES PATENTS

| | | | |
|---|---|---|---|
| 482,814 | 9/1892 | Smedley | 417/318 |
| 2,300,110 | 10/1942 | Hoog | 417/402 |
| 2,510,649 | 6/1950 | Neff | 417/318 |
| 2,819,928 | 1/1958 | Liedberg | 417/317 X |

FOREIGN PATENTS OR APPLICATIONS

| | | | |
|---|---|---|---|
| 1,182,389 | 1/1959 | France | 417/402 |

*Primary Examiner*—Carlton R. Croyle
*Assistant Examiner*—Richard E. Gluck
*Attorney, Agent, or Firm*—Paul L. Sjoquist

[57] ABSTRACT

Apparatus is disclosed for actuating hydraulic motor control valves in a predetermined timed relationship relative to a pump inlet valve, wherein the pump is connected to and driven by the hydraulic motor, to improve the metering capabilities of the motor-pump combination.

10 Claims, 3 Drawing Figures

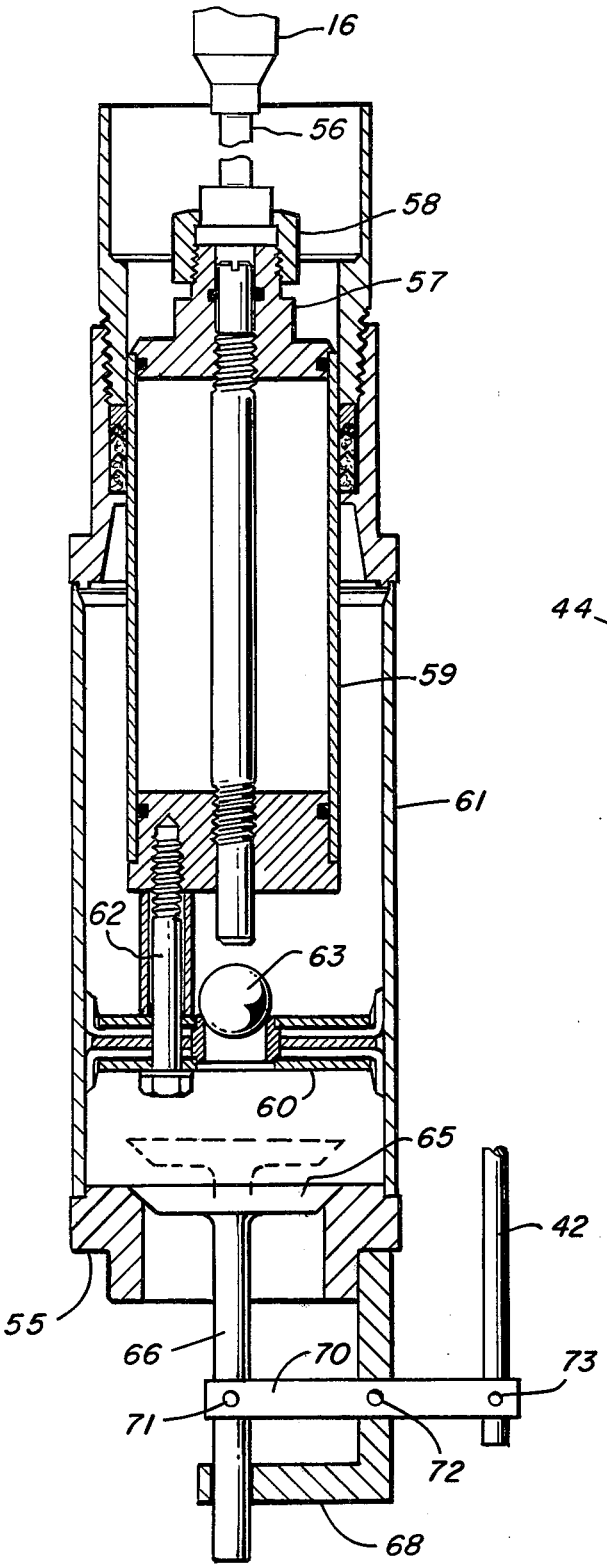
FIG. 3
FIG. 2
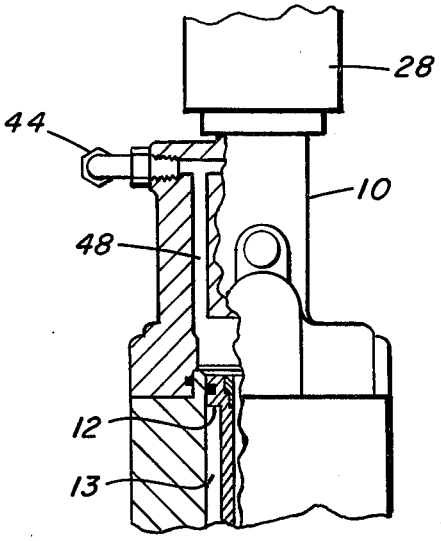

FLUID MOTOR DRIVES PUMP HAVING AN ACTIVE INLET VALVE

This invention relates to an apparatus for improving the operation of reciprocating motors and pumps. More specifically, the invention is particularly adaptable as an improved valving machanism for hydraulically-operated reciprocating motors.

BACKGROUND OF THE INVENTION

In the past, reciprocating piston pumps have been driven by reciprocating air motors. These air motors use compressed air to reciprocate a motor piston, which in turn is connected to a suitable reciprocating pump. Systems of this type delivered fluid through the pump at an irregular rate, caused principally by the non-linearities which occur at the time the air motor piston changes direction. Because of the compressibility of the air used to activate such systems, the air motor piston reacts slowly at its extreme displacement positions, commonly referred to as the "change-over." The finite time required for the compressed air supply to regenerate sufficient internal pressure to move the air motor piston causes a temporary reduction in pumped fluid flow, and thus the fluid flow is irregular during changeover.

The use of hydraulic motors has improved the uniformity of pumped fluid flow, because hydraulic motors utilize incompressible hydraulic fluid for their driving source and thus are able to go through changeover faster than air motors. In addition, the valving of hydraulic fluid is more positively controllable than air, and hydraulic motors therefore respond more directly to control valving. Thus, the use of hydraulic motors has improved the speed of changeover and thereby provided a more uniform output flow from the reciprocating pump connected to the hydraulic motor. However, this improved changeover speed causes additional problems which affect the metering and flow rate of the pumped fluid. An effect called "diving" becomes more pronounced, particularly when hydraulic motors are used to pump highly viscous materials and fluids.

Experimentation has shown that "diving" is caused by at least three factors. The first of these is fluid cavitation caused by the limited area of the pump inlet valve, which results in a significant pressure drop across the valve and thereby produces cavitation chambers in the pump cylinder below the pump piston. As the hydraulic motor goes through top changeover the force on the pump piston is suddenly reversed and a rapid downward piston movement occurs to fill the cavitation chambers. This sudden downward movement creates a pump cylinder flow rate demand above the piston which cannot be met because of the limited orifice size of the valving feeding the cylinder in this region. Therefore, additional cavitation chambers are produced in the pump cylinder above the piston to create the second factor causing "diving."

The third factor which causes "diving" is valve closure loss which usually occurs after the first mentioned cavitation chambers have been filled but before the second mentioned cavitation chambers have been filled. The pump piston, in its downward movement, fills the first mentioned cavitation chambers but continues to move downward rapidly because the pump inlet check valve remains open for a finite time. Pumped fluid flowing around this check valve adds a downward drag force to assist in closing the valve, but that same material is lost until the valve is fully closed. Once the inlet check valve is closed, pump piston velocity remains above its steady state value until the second mentioned cavitation chambers have been filled. After this occurs, the pump reaches a steady state velocity and thereafter operates as a positive displacement pump. However, during the "diving" period, the pump does not operate as a positive displacement pump, delivering less pumped fluid per increment of displacement than it delivers during steady state operation. Therefore, "diving" not only produces poor fluid flow but contributes to accuracy errors in metering the amount of fluid pumped.

The present invention overcomes the disadvantages caused by "diving" by providing an improved hydraulic valving mechanism which overcomes the cavitation problems that cause "diving."

SUMMARY OF THE INVENTION

This invention comprises an improved poppet valve which functions as the pump cylinder inlet valve, and is actuated by means of a linkage connected to a hydraulically activated cylinder. The poppet valve provides a pump inlet area larger than can be obtained with conventional ball check inlet valves, and thereby eliminates one of the factors contributing to the aforementioned cavitation. The hydraulic cylinder is activated by means of a novel valving mechanism which provides for a full closure of the poppet valve before hydraulic fluid force is applied to the motor piston. This eliminates the loss of pumped fluid through the poppet valve during changeover and thereby eliminates the remaining effects which contribute to the aforementioned cavitation. Therefore, the "diving" condition common to hydraulic motor/pump combinations is effectively eliminated by the apparatus of the present invention.

It is therefore an object of the present invention to provide an improved hydraulic motor to eliminate cavitation effects which result in irregular flow of pump fluid;

It is another object of this invention to provide an improved hydraulic motor valving means to ensure the full closure of the pump inlet valve prior to completing hydraulic motor changeover;

It is yet another object of this invention to provide a hydraulic motor and pump combination which delivers pump fluid at a regular flow rate with a minimum of interruptions caused by hydraulic motor changeover.

These and other objects and advantages will become apparent upon a reading of the following specification and claims, and with reference to the appended drawings, in which:

FIG. 2 shows a side view in partial cross section; and

FIG. 3 illustrates the improved pump inlet valve of this invention;

DETAILED DESCRIPTION OF THE INVENTION

Figure 1:
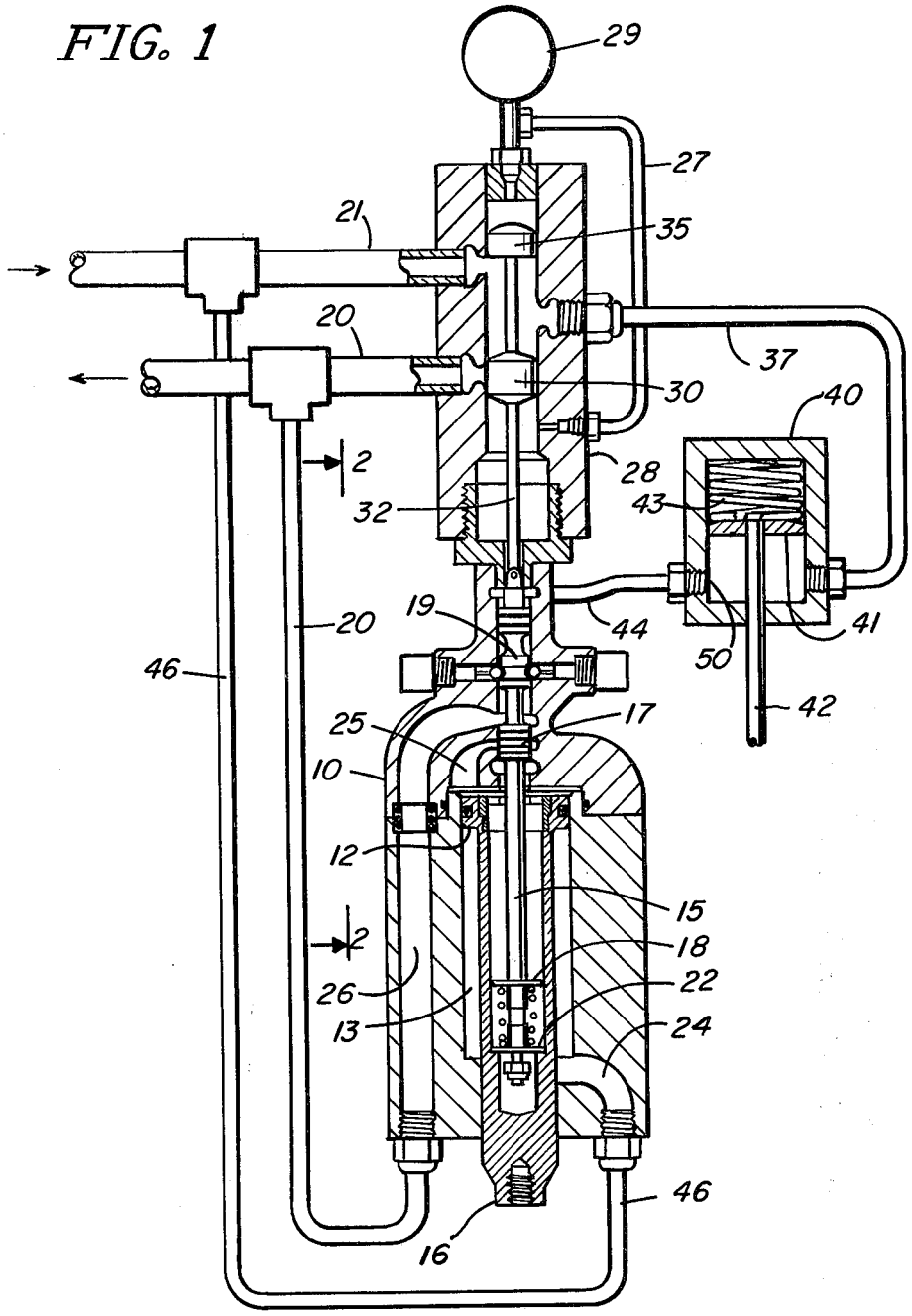
FIG. 1 illustrates the improved hydraulic motor valving mechanism of this invention.

Referring first to FIG. 1, a hydraulic motor is shown in cross section with suitable hydraulic valving attached thereto to accomplish the functions embodied in this invention. The hydraulic motor 10 is typical of any number of well known manufactured products, as for example, hydraulic motors manufactured by the assignee of the present invention. Hydraulic motor 10 utilizes a piston 12 which reciprocates within a cylinder 13 under the influence of pressurized hydraulic fluid. The pressurized hydraulic fluid is valved through the various motor passages to the upper and lower surfaces of piston 12. A hydraulic fluid return pipe 20 is also connected to internal passages to provide a conduit for returning the hydraulic fluid to a suitable reservoir. Hydraulic fluid inlet pipe 21 transfers hydraulic fluid from the same hydraulic reservoir under pressure into the apparatus.

Motor piston 12 has a greater surface area exposed to pressurized hydraulic fluid within cylinder 13 on its top surface than it does on its bottom surface. Therefore, when pressurized hydraulic fluid is admitted into both the top and bottom of cylinder 13, a net downward force is exerted against piston 12 to thereby cause it to move downward. Upward movement of piston 12 is caused by relieving the pressure source supplied to the top surface of the piston, thereby creating a net upward force against the piston's lower surface. A valve rod 15 projects through the piston, and has a spool valve 17 positioned above the piston and a spring toggle mechanism 18 at its lower end. Thus, when piston 12 approaches its lower displacement limit, the underside of piston 12 contacts spring toggle 18 to force valve rod 15 downwardly. A detent mechanism 19 on valve rod 15 is overcome by this downward force and spool valve 17 is forced into a first valve position. During the upstroke of piston 12, and near its upper displacement limit, a shoulder 22 contacts the lower end of spring toggle 18 to force valve rod 15 upwardly. Again, detent mechanism 19 is overcome and spool valve 17 moves to a second position as shown in FIG. 1. The two positions of spool valve 17 permit hydraulic fluid to either communicate with piston 12 or vent the region above piston 12 to passage 26.

The upper end of valve rod 15 is mechanically connected to a valve rod 32 attached to a spool valve 30 and a spool valve 35. When valve rod 15 is in its first or "down" position, spool valve 35 blocks the pressurized fluid in hydraulic fluid inlet 21. When valve rod 15 is in its second or "up" position, as shown in FIG. 1, spool valve 30 blocks hydraulic fluid return line 20. The operation and function of each of these valves will be explained in more detail hereinafter.

Spool valves 30 and 35 are housed in valve housing 28. Valve housing 28 is secured atop hydraulic motor 10 so that valve rod 15 is in linear alignment with valve rod 32. A hydraulic fluid accumulator chamber 29 is connected to the top of valve housing 28, and a passage extends between the interior of valve housing 28 and accumulator 29. A pressure relief pipe 27 equalizes the pressure between the top and bottom portions of the interior of valve housing 28, by maintaining a fluid path between the respective outside ends of spool valves 30 and 35.

It thus can be seen that the entire assembly comprising valve rod 15 and valve rod 32, including the spool valves associated therewith, is movable into two positions at the displacement limits of hydraulic motor piston 12. When hydraulic motor piston 12 reaches its maximum bottom displacement it forces the aforementioned valve rods and valves into a first or "down" position, which position causes the valving to divert pressurized hydraulic fluid from the upper end of cylinder 13 so as to exert thereafter a net upward force against piston 12. When the valve rods and valves are forced into a second or "up" position by the maximum top displacement of piston 12, the respective valves cause pressurized hydraulic fluid to be diverted into the top region of cylinder 13 so as to cause a net downward force thereafter against piston 12. To summarize, when the spool valves are in their "down" position the hydraulic motor piston 12 is being driven upwardly; when the spool valves are in their "up" position the hydraulic motor piston 12 is being driven in a downwardly direction. With an understanding of this general convention of operation with respect to hydraulic motor 10 and its associated valving, the advantages and features of the present invention can now be explained.

The source of pressurized hydraulic fluid (not shown) is connected to valve housing 28 via hydraulic fluid inlet 21. When spool valve 35 is in its "up" position pressurized hydraulic fluid is passed into pipe 37 which is also connected to valve housing 28. Pipe 37 connects to hydraulic cylinder 40, and exerts an upward force against plunger 41 sufficient to overcome the downward force of compression spring 43. Therefore, plunger 41 moves upwardly, causing valve rod 42 to move upwardly. Pressurized hydraulic fluid also leaves hydraulic cylinder 40, and is connected to a hydraulic motor 10 inlet to be hereinafter described via pipe 44. However, the cross sectional area of valve outlet 50 from hydraulic cylinder 40 is approximately one-half the cross sectional area of the inlet pipe 37 to cylinder 40, thereby allowing a back pressure to be built up within hydraulic cylinder 40 to cause the upward movement of valve rod 42 to occur before pipe 44 becomes fully pressurized. Thus, valve rod 42 moves upwardly before the hydraulic motor 10 receives its full internal hydraulic pressure for changing piston direction.

FIG. 2 shows the hydraulic motor 10 passages connected to pipe 44. Pressurized hydraulic fluid entering hydraulic motor 10 via pipe 44 is coupled through motor passage 48 down to the region inside cylinder 13 which is above the top surface of piston 12. This pressurized hydraulic fluid acts over the entire top surface area of piston 12, which is greater area than the is a fluid in cylinder 13 which acts over the bottom surface of piston 12. Passage 25 also connects into the top region of cylinder 13, and is therefore also filled with pressurized hydraulic fluid. However, spool valve 17 blocks passage 25 from return passage 26 and the pressurized hydraulic fluid is therefore confined in the top region of cylinder 13. The net result is that a downwardly force is created against piston 12 to drive it in a downwardly direction.

When piston 12 moves downwardly the entire assembly connected to piston 12, including sleeve 16, also moves downwardly. Sleeve 16 is connected to the pump which will be hereinafter described to cause the pump piston to follow the motion of piston 12.

At some point near the end of its downward displacement the underside of piston 12 comes into contact with the spring toggle mechanism 18 on valve rod 15. When this occurs, and as further downward piston travel takes place, spring toggle 18 is compressed until the downward force on toggle 18 exceeds the detent force of detent mechanism 19. At this point, valve rod 15 snaps downwardly to its first position and the motor valving is changed so as to cause an upward force against motor piston 12. After such downward motion of valve rod 15 has taken place, spool valve 35 moves into closing relationship with hydraulic fluid inlet 21, thereby blocking the flow of pressurized hydraulic fluid from valve housing 28. Spool valve 30 moves into opening relationship with hydraulic fluid return 20, thereby exposing the inner passage of valve housing 28 to the hydraulic return line. Hydraulic fluid in pipe 37 is thereby passed to the hydraulic fluid return line 20, and hydraulic pressure within hydraulic cylinder 40 is relieved. The force of compression spring 43 then causes plunger 41 and valve rod 42 to move downwardly, which in turn causes an opening of the pump inlet valve as will be hereinafter described.

When spool valve 17 moves into its "down" position, passage 25 becomes opened to return passage 26, thereby relieving the hydraulic fluid pressure from cylinder 13 in the region above the top surface of piston 12. The hydraulic fluid pressure within cylinder 13 in the region below the bottom surface of piston 12 remains, however, because passage 24 is connected via hose 46 to hydraulic fluid inlet 21 ahead of its connection with valve housing 28. Therefore, only the pressurized hydraulic fluid in cylinder 13 under piston surface 12 remains and a net upward force is exerted against piston 12. This force causes an upward displacement of piston 12 and sleeve 16 until the upper displacement limit is reached, wherein the operation repeats itself as described hereinbefore.

FIG. 3 illustrates the fluid pump usable with this invention. The pump may be adapted from any of a number of well known fluid pumps, such as pumps manufactured by the assignee of the present invention. Sleeve 16 (see FIG. 1) connects to pump piston 60, which is slideable within pump cylinder 61. This connection is made via a threaded shaft 56 which connects sleeve 16 to the upper pump assembly 57 by a collar 58. Upper pump assembly 57 is rigidly connected to a pump sleeve 59, which in turn is bolted to piston 60 (as, for example, by bolt 62). The entire pump assembly is constructed so that the reciprocating motion of motor sleeve 16 is transmitted to pump piston 60 to also cause it to reciprocate. Piston 60 is snugly fitted against the interior walls of pump cylinder 61 to provide a sealable, sliding pump stroke.

Threadably attached to the bottom of cylinder 61 is a valve housing 55. Poppet valve 65 is seated within valve housing 55, and has a valve stem 66 extending downwardly through a valve guide 68. Lever 70 is pivotally attached to valve stem 66 by means of pin 71. Lever 70 is pivotally attached to valve guide 68 by means of pin 72. Finally, lever 70 is pivotally attached to valve rod 42 by means of pin 73. The arrangement of these pivotal connections is such that a downward movement of valve rod 42 causes an upward movement of poppet valve 65. Valve rod 42 is attached, as hereinbefore described, to plunger 41 and its upward and downward movement is controllable by the relative opposing forces of hydraulic pressure within cylinder 40 and compression spring 43. In the preferred embodiment, the components are arranged to provide a valve stroke for poppet valve 65 on the order of ½-inch, as illustrated by the dotted lines of FIG. 3.

Poppet valve 65 remains in its open position during the upstroke of piston 60, thereby allowing pumped fluid to be drawn into the cylinder 61. During the downstroke of piston 60, poppet valve 65 is closed and ball valve 63 opens to allow the fluid within cylinder 61 to be pumped through the pump delivery lines (not shown).

During the downstroke of hydraulic motor piston 12 and pump piston 60, poppet valve 65 remains in its closed position as shown in FIG. 3. Near the point of maximum downward displacement, the aforementioned spool valves change their position and relieve the hydraulic fluid pressure above motor piston 12 and within hydraulic cylinder 40. Compression spring 43 within hydraulic cylinder 40 then forces plunger 41 and valve rod 42 downwardly. The downward motion of valve rod 42 causes lever 70 to become activated and thereby moves poppet valve 65 upwardly to an open position. Simultaneously, pressure in hydraulic motor 10 beneath piston 12 creates an upward force and the hydraulic motor piston 12 begins moving upwardly. Pump piston 60 follows in an upwardly direction to cause pumped fluid to be drawn into cylinder 61.

Near the upper displacement limit of hydraulic motor piston 12 the aforementioned spool valves are again caused to change position. This causes a flow of pressurized hydraulic fluid to be built up within hydraulic cylinder 40, causing valve rod 42 to move upwardly. When valve rod 42 moves upwardly, its connection via lever 70 causes poppet valve 65 to close. As hereinbefore described, the build up of hydraulic fluid pressure within hydraulic cylinder 40 proceeds ahead of the full pressure build up within hydraulic motor 10. (Valve restrictor 50 prevents an immediate flow of hydraulic fluid via pipe 44 into the region above hydraulic motor piston 12.) Therefore, poppet valve 65 is almost fully closed before hydraulic pressure builds up sufficiently above motor piston 12 to cause the downward force necessary to begin moving the motor piston downwardly. This sequence of operation assures that pump piston 60 will have negligible downward movement prior to full closure of poppet valve 60 and thereby greatly improves the metering capability of the system. During the downstroke of pump piston 60, ball valve 63 is forced open and all of the material trapped within cylinder 61 is forced upwardly and out through the fluid delivery system (not shown).

Thus, it can be seen that the present invention provides a valving apparatus for ensuring the proper sequencing and complete activation of the pump foot valve at the respective motor stroke limits and before any substantial subsequent motor piston movement takes place. This provides a significant improvement in the predictability of the quantity of fluid pumped by the apparatus, as a function of pump piston linear movement, and results in an improved metering pump system.

What is claimed is:

1. In a reciprocating hydraulic motor and pump assembly, wherein the pump is mechanically linked to the reciprocating hydraulic motor and the motor has a hydraulic fluid inlet to its piston cylinder controllable by a valving mechanism responsive to motor piston displacement, the improvement comprising:

a. a hydraulic fluid line interposed between said motor hydraulic fluid inlet and said controlling valving mechanism, and having a hydraulic cylinder interposed therein, said hydraulic cylinder having a spring biased piston actuable by said hydraulic fluid and a valve rod connected to said spring biased piston;

b. a poppet valve positioned at the pump inlet;

c. means for connecting said valve rod to said poppet inlet valve to cause said poppet valve to open and close in response to said valve rod activation; and d. further means connected between said hydraulic cylinder and said motor hydraulic fluid inlet for restricting hydraulic fluid flow to said inlets until said valve rod is activated.

2. The apparatus of claim 1 wherein said means for connecting said valve rod to said poppet inlet valve further comprises a pivotable lever between said valve rod and said poppet valve.

3. The apparatus of claim 2 wherein said further means for restricting hydraulic fluid flow further comprises a passage of reduced cross sectional area in said hydraulic fluid line.

4. The apparatus of claim 3 wherein the ratio of the sizes of the reduced cross sectional area passage to the hydraulic fluid line cross sectional area is less than 1:1.

5. In a system operated from a pressurized hydraulic fluid source, including a reciprocating hydraulic motor and driven pump having an inlet for immersion into fluid to be pumped, the improvement for controlling pump inlet valving in coordination with extremes in motor piston displacement comprising:

a. means for sensing said motor piston displacement extremes and means for valving hydraulic fluid in response thereto;

b. a hydraulic cylinder and plunger means connected to said means for valving hydraulic fluid, for causing mechanical motion of said plunger in response to valved hydraulic fluid;

c. a poppet valve positioned in opening and closing relationship to said pump inlet;

d. means for coupling said plunger mechanical motion to said poppet valve; and e. means for coupling hydraulic fluid from said hydraulic cylinder to said hydraulic motor, said coupling means having a region therein restricting hydraulic fluid flow.

6. The improvement of claim 5 wherein said hydraulic plunger is further spring biased in a first position and said hydraulic fluid acts in opposition thereto against said piston.

7. Apparatus for controlling the valving from a source of pressurized hydraulic fluid in synchronism with the valving of a pump, in the mechanically-linked combination of a hydraulic motor, reciprocable hydraulic motor piston and pump, comprising a. means for sensing the two hydraulic motor piston displacement extremes, actuated by said piston and connected to a first valve rod to cause mechanical movement of said first valve rod at said displacement extremes;

b. a valve assembly having an inlet and return line connection to said source of pressurized fluid, and having an outlet port, and having valve means connected to said first valve rod for controllably coupling said outlet port respectively to said inlet and return line;

c. a spring-biased piston and cylinder assembly, having its cylinder connected to said outlet port and connected to said hydraulic motor through a restricted port, said spring-biased piston having attached thereto a second valve rod; and d. an externally actuable inlet valve in said pump, having an actuating mechanism connected to said second valve rod; whereby said spring-biased piston becomes actuated by said pressurized hydraulic fluid in synchronism with said hydraulic motor piston actuation.

8. The apparatus of claim 7 wherein said valve assembly valve means further comprises a plurality of spools in linear actuating alignment.

9. The apparatus of claim 8 wherein said externally actuable pump inlet valve further comprises a poppet valve having an externally projecting valve stem.

10. The apparatus of claim 9, wherein said pump inlet valve actuating mechanism further comprises a pivotal lever pivotally attached to said pump, and having a first end connection to said valve stem and a second end connection to said second valve rod.

* * * * *